United States Patent [19]

Hsiao et al.

[11] 4,245,575

[45] Jan. 20, 1981

[54] LUBRICATION SYSTEM FOR SEWING MACHINE

[75] Inventors: James C. Hsiao, Morton Grove; Yoichiro Ishikawa, Villa Park, both of Ill.

[73] Assignee: Union Special Corporation, Chicago, Ill.

[21] Appl. No.: 58,211

[22] Filed: Jul. 16, 1979

[51] Int. Cl.[3] ..... D05B 71/00

[52] U.S. Cl. ..... 112/256; 184/6.15

[58] Field of Search ..... 184/6.15, 6.1; 112/256, 112/43; 173/DIG. 3; 139/1 R; 74/467; 123/196 R; 210/168

[56] References Cited

U.S. PATENT DOCUMENTS

| | | | |
|---|---|---|---|
| 710,026 | 9/1902 | Weiss | 123/196 R |
| 768,038 | 8/1904 | Fennis et al. | 123/196 R |
| 1,135,601 | 4/1915 | Marshall | 184/6.15 |
| 1,350,729 | 8/1920 | Kiewicz . | |
| 1,682,565 | 8/1928 | Hill . | |
| 1,936,372 | 11/1933 | Waterman . | |
| 2,529,573 | 11/1950 | Ritter . | |
| 2,833,374 | 5/1958 | Glasser | 184/6.1 X |
| 2,939,415 | 6/1960 | Wizase . | |
| 3,013,632 | 12/1961 | Matsubara | 112/256 X |
| 3,406,788 | 10/1968 | Weisz | 112/256 X |
| 3,407,741 | 10/1968 | Weber et al. | 123/196 R |
| 3,486,582 | 12/1969 | Carter et al. | 123/196 R |
| 3,674,112 | 7/1972 | Roberts | 184/6.1 |
| 3,976,165 | 8/1976 | Pilarczyk | 184/6.1 |
| 4,095,674 | 6/1978 | Kido et al. | 184/6.1 |

*Primary Examiner*—Werner H. Schroeder
*Assistant Examiner*—Andrew M. Falik
*Attorney, Agent, or Firm*—John W. Harbst; John A. Schaerli

[57] ABSTRACT

This disclosure relates to a sewing machine lubrication system including positive displacement mechanisms adapted to transmit lubricant under pressure to the operating mechanisms of the machines and for transferring lubricant collected in non-drainable areas of the machine to the lubricant reservoir. Arranged in combination with the displacement mechanisms is a filtering-/distribution assembly which serves to individually and selectively supply a relatively small, but sufficient quantity of lubricant to the operating mechanisms according to the requirements thereof. The present invention further provides a pressure relief valve assembly for selectively regulating the pressure in the lubrication system.

13 Claims, 13 Drawing Figures

16
12
14
28
30
30a
30b
32
34
35
36
40
42
44
46
48
50
52
54
56
60
62
64
66
68
74
75
86
88
90
92
94
96
98
100
102
3
4

26
24
184
182
168
132
180
146
181
164
140
122
148
166
16
14
12
120
11

16
12
128
20
132
FROM PUMP ASSY. 46
140
122
134
136
168
124
14
168

LUBRICATION SYSTEM FOR SEWING MACHINE

FIELD OF THE INVENTION

The present invention relates, in general, to sewing machines and is more particularly concerned with a lubrication system for sewing machines.

BACKGROUND OF THE INVENTION

In modern sewing machines, particularly of the industrial type, it is frequently desirable to use high speed operation. When using high speed operations, however, a problem may result in that moving parts within the frame of the machine have a tendency to overheat, with resulting deterioration of lubricant and parts of the machine. Lubricating systems have been suggested in which there is provided means for supplying lubricant to the various areas of the machine, but without any regard for the quantities of lubricant that are being delivered to the various mechanisms. In this regard, these known systems have the drawback of supplying surplus quantities of lubricant in order to insure lubrication of the bearings and bushings of and, thus, there is great likelihood of excess lubricant leaking from the bearing surfaces, not only when the machine is running, but also after the machine has come to a stop. In addition, an excess amount of lubricant means that reduntant work is being done in supplying excessive or unnecessary power consumption. Excess heat at the bearing may also occur as a result of surplus lubricant being supplied to the bearing.

The quantity of lubricant required by one specific mechanism, i.e. the feed mechanism of the machine, may be different from that required by another mechanism, i.e. the drive mechanism for an operating tool. It has been found that the quantity of lubricant required for or by each mechanism is dependent upon such variable factors as the dynamic loading characteristics of the mechanism, the desired rate of heat removal, the type of bearings used, etc. Besides its function of reducing friction between bearing components, lubrication may also help to protect the bearings or bushings from corrosion and act as the heat transferring media. To best accomplish these purposes, it is essential that the quantity of lubricant be accurately adapted to the conditions under which the bearings and lubricant must operate. As mentioned, too much lubricant may result in excessive heat generation due to shearing the excess amount of lubricant supplied. Too little lubricant may not maintain an adequate lubricating film within the bearing which may result in abnormal wear and heat build-up. For the reasons discussed herein above, it has been found necessary to conceive and develop a lubrication system which will satisfy all of the requirements set forth above and overcome the drawbacks of the prior systems.

SUMMARY OF THE INVENTION

The present invention will be particularly described in its application to a sewing machine, although it will be appreciated that many of the principles and techniques advanced herein may be equally applicable to other machines as well. With the machine under consideration, there are a plurality of widely distributed operable mechanisms which require lubrication. Thus, in the presently preferred embodiments, a force flow lubrication system has been found preferable. In order to optimize its anti-frictional and heat dissipation characteristics, the present invention provides means for individually measuring the quantity of lubricant that is delivered to the various mechanism in relatively small, yet accurately proportioned, quantities according to the requirements of the various mechanisms. The metered quantities of lubricant will give sufficient and ample lubrication without overflow or excess lubricant on the machine regardless of the relative inaccessibility or accessibility of the mechanism, varying conditions or various temperatures all of which may change certain characteristics of the lubricant.

In the presently preferred form, there is provided a lubricant reservoir and a positive displacement mechanism or pump means, the input shaft or rotor of which may be co-axially aligned with and actuated by an associated mechanism of the machine. The pump means is effective to transmit lubricant under pressure to the operating mechanisms of the machine and for transferring lubricant collected in non-drainable areas of the machine to the lubricant reservoir. Arranged in combination with the displacement means are a series of adjustable restricting means adapted to regulate the flow of lubricant in amounts corresponding to the relatively minute quantities required of the particular mechanism. It may be worthy to note that the adjustable restrictive means may correspond in number to the operating mechanisms arranged in the frame of the machine. In view of the fact that there has been provided a positive displacement pump means in combination with a restrictive control flow mechanism, it has been found desirable to provide a pressure relief valve assembly which is rendered effective when the pressure of the lubricant exceeds some predetermined limit. In this manner, if the lubricant pressure exceeds the upper limit, the pressure relief valve assembly is effective to return the excess lubricant to the reservoir whereby assuring an efficient and effective force feed lubrication system by maintaining the lubricant pressure within the machines' operating speed ranges. That is, the delivery of lubricant is not dependent upon the speed of the machine.

When working in an environment of dust or dirt, it may be appreciated that regardless of the care utilized in maintaining a clean supply of lubricant in the machine reservoir it may invariably become contaminated, to some degree, by a form of foreign matter. It was found desirable, therefore, to provide a dual filtering system. The dual filtering system includes a first stage filter that is adapted to filter large contaminants and a second stage filter. The second stage filter is adapted to screen the lubricant immediately prior to its delivery to the restrictive control means of the invention. In view of the close relationship desired between the second stage filter and the metering means, the present invention has provided a modular housing which contains both the filtering apparatus and the metering means, thus facilitating the ease of replacement when necessary.

The lubrication system of the present application also incorporates a flow indicator sight gauge. This gauge will readily lend to the machine operator a quick visual indication of the oil flow throughout the lubrication system.

In view of the above, it is the primary object of this invention to provide an automatic lubrication system that is simple, economical, effective and dependable and that will provide for operation of the machine at very high speeds.

It is also among the particular objects of the present invention to provide a new and improved system of lubrication which is adapted to supply sufficient and ample lubrication without overflow or excess to the various mechanisms of the machine.

Another object of this invention is to provide a lubrication system for a machine which will automatically be actuated by a mechanism of the machine and will supply the proper proportions of lubricant to the various mechanisms according to the requirements thereof.

It is a further object of the present invention to provide a lubrication system which will operate automatically over long periods of time, without appreciable attention from the operator.

Yet another object of this invention is to provide a lubrication system which incorporates adjustable restrictive means whereby small compensatory variations in the flow of lubricant may be made with both ease and accuracy.

Another object of this invention is to provide a force flow lubrication system for a machine in accordance with the foregoing objects in which lubricant is presented to the metering means in a filtered state and under a predetermined or pre-set constant pressure.

Another object of the present invention is to provide a system of lubrication which is comprised primarily of a multiplicity of modular mechanisms for delivering metered quantities of lubricant under pressure throughout the operation of the machine.

BRIEF DESCRIPTION OF THE DRAWING

Having in the mind the above and other objects that will be evident from an understanding of this disclosure, the invention comprises the devices, combinations and arrangements of parts as illustrated in the presently preferred embodiment of the invention which is hereinafter set forth in such detail as to enable those skilled in the art readily to understand the function, operation, construction and advantages of it when read in conjunction with the accompanying drawings in which.

DESCRIPTION OF THE PREFERRED EMBODIMENT

Figure 1:
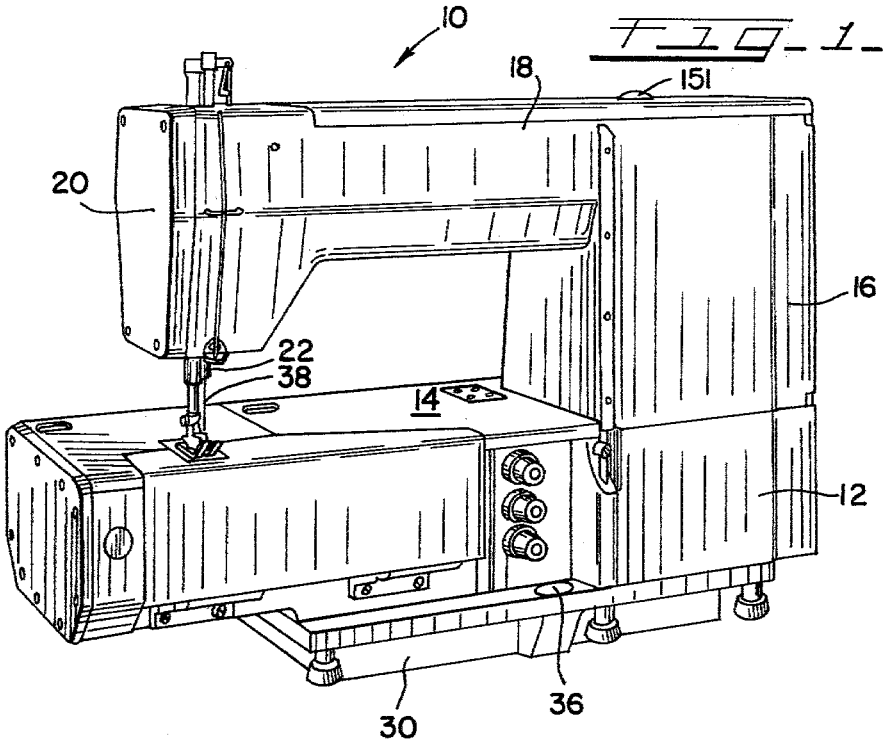
FIG. 1 is a perspective view of a machine incorporating the present invention.
Figure 4:
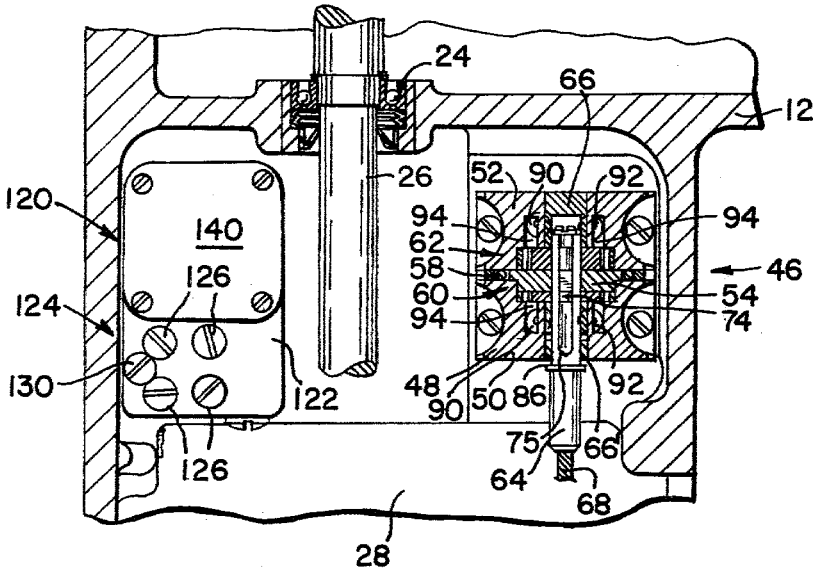
FIG. 4 is a fragmentary top sectional view, taken along line 4—4 of FIG. 3.

Referring now in more detail to the drawings in which like reference numerals indicate like parts throughout the several views, the machine within which the present invention is embodied is a high speed industrial sewing machine 10, having a frame comprising a bed 12 which is fitted with a work support plate 14. Rising from the right hand end of the bed portion 12 is a hollow vertical standard 16 which may be secured to the bed by any suitable means. The standard 16 has a hollow arm or bracket 18 extending laterally from its end so as to overhang the bed, the arm 18 having a hollow head 20 at its free end. Within the head 20 there may be provided needle bar means 22 which may be suitably supported for endwise movement and mechanism means (not shown) for reciprocating the needle bar. The mechanism means for reciprocating the needle bar may be of similar construction to that disclosed in U.S. application Ser. No. 908,199 filed May 22, 1978. Rotatably mounted beneath the work support plate 14 and arranged longitudinally of the machine frame 12 in bearings 24, preferably anti-friction bearings, is a lower main or bed shaft 26. The bed shaft 26 extends through a "dry" machine area or mechanism chamber 28 and beyond the end wall of the machine. The outer projecting end of this shaft has suitably secured thereto a combined handwheel and belt pulley means (not shown) about which a belt is adapted to be entrained for the purpose of delivering power to the machine. At its other end, the shaft 26 is associated with the feed mechanism (now shown) of the machine. The feed mechanism may be of any suitable type and well known to one skilled in the art of sewing.

Figures 2, 3:
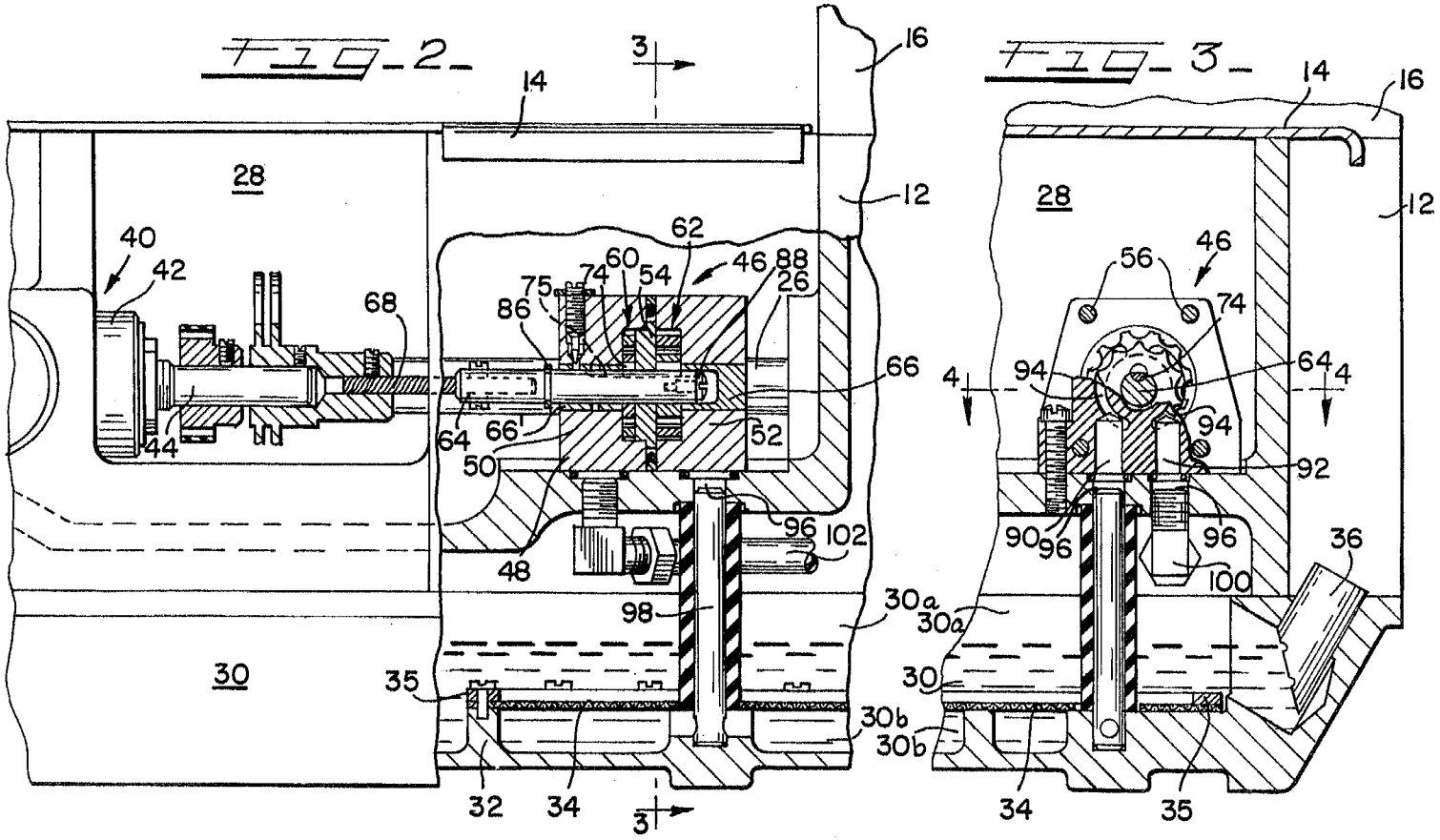
FIG. 2 is a fragmentary front elevational view, taken partially in section, illustrating the lubricant pump assembly of the present invention.
FIG. 3 is a fragmentary side sectional view, taken along line 3—3 of FIG. 2.

Referring now to FIGS. 2 and 3, secured to the open underside of the bed 12 is a lubricant reservoir or cavity means 30 which is adapted to receive the lubricant that is to be delivered to the various operable mechanisms of the machine. The lubricant reservoir means 30 is divided into a main chamber **30*a* for holding unfiltered lubricant and a smaller chamber 30*b* for holding filtered lubricant. The smaller chamber, 30*b*, is defined by wall-like partitions 32 which may be covered by a first stage filter means which, in the presently preferred embodiment, is defined by a large filtering member 34. Lubricant entering or flowing through the filter 34 will thus be filtered in the process, thereby preventing large undesirable contaminants from entering the lubrication system. The filtering member 34 is preferably formed from a layer of screen or other suitable material which may be held in place by a suitably formed plate-like means 35. There may also be provided a transparent site gauge 36 of the type described in U.S. Pat. No. 2,301,460 granted to Sauer on Nov. 10, 1942 for indicating the level of lubricant in the reservoir or cavity means 30**.

For purposes of this description, the present invention will be described as being embodied in a chainstitch sewing machine, but it will be appreciated that certain aspects of this invention are appropriate for more general applications. One of the identifying features of this specific type of sewing machine is that it is provided with a looper means (not shown) which is adapted to cooperate with the needle means 38 in the formation of chain stitches. In the presently preferred embodiment the looper means is driven by a modular looper drive assembly generally designated in the drawings as 40; the construction of which is incorporated herein by reference from U.S. application Ser. No. 877,065 filed Feb. 13, 1978. As described in said application, the looper drive assembly 40 may be slideably received in the bed portion 12 of the machine. The movement of the looper drive means permits adjustment of the looper avoid motion imparted to the looper. For purposes of this description, suffice it to say that the modular looper drive assembly 40 includes an annular housing means 42 and a stub shaft means 44 suitably supported for rotation within the housing. As seen in FIG. 2, the right end of shaft 44 projects beyond the housing 42 along an axis parallel to the longitudinal axis of the main shaft 26 and is operatively driven thereby.

Figure 13:
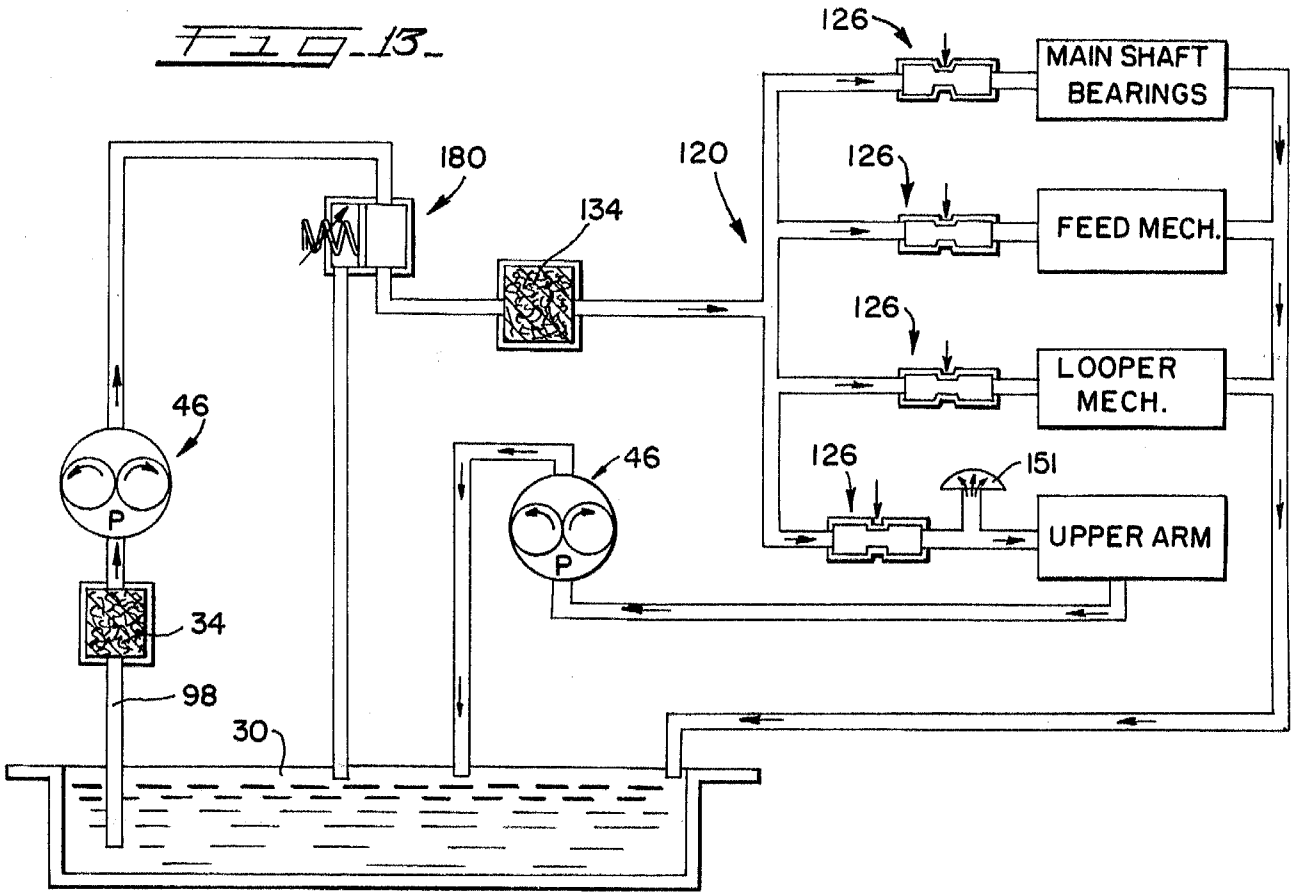
FIG. 13 is a schematic representation of the present invention.

Broadly stated and with reference to the schematic representation shown in FIG. 13, it may be seen that the lubrication system which forms the subject matter of the present invention includes the lubricant reservoir means 30, a modular pump assembly 46 and a lubricant metering assembly 120 including a series of adjustable restrictive valve means and a dual filtering system. As mentioned earlier, one advantage of the present invention is that the entirety of the lubricating system is mounted within the confines of the frame of the machine.

The modular lubricant pump assembly best illustrated in FIGS. 2, 3, 4 and 5 is indicated as an entirety by reference numeral 46. The pump assembly may be secured, in an oil-tight fashion, in the "dry" chamber 28 of the machine by any suitable means and is adapted to deliver lubricant under pressure from the reservoir means 30 to a lubricant distribution means, described hereinafter, at substantially constant volumetric quantities over a range of machine speeds. The lubricant pump assembly 46 includes a casing or housing means 48 made up of two complimentary separable pump bodies 50 and 52. The pump bodies are operably separated by partition means 54 interposed therebetween, all of which is held in rigidly assembled relation by a series of retainer means 56. A sealing means 58 is clamped between the pump bodies when assembled for the purpose of preventing lubricant from escaping into the "dry" chamber.

The pump assembly 46 preferably comprises two separate positive displacement pump means provided by two pair of gerotor-type assemblies 60 and 62. The gerotor pumps are correspondingly driven with the operation of the machine and are adapted to work in concert with one another. The tandemly mounted gerotor pumps 60 and 62 are slideably mounted on a drive shaft 64, which is received in a sleeve bearing 66 mounted within an opening in the pump body 50. One end of the drive shaft 64 extends outwardly beyond the pump assembly and is adapted to be driven by a suitable rotary driving component of the machine such as the drive shaft 44 of the looper drive assembly 40. With the present invention, it has been found preferable to axially align shafts 64 and 44 so as to minimize the radial forces and bending moment applied to the bearings supporting the shaft 64. A type of flexible coupling 68 is used for operatively connecting the shaft 64 with the drive means.

Figure 5:
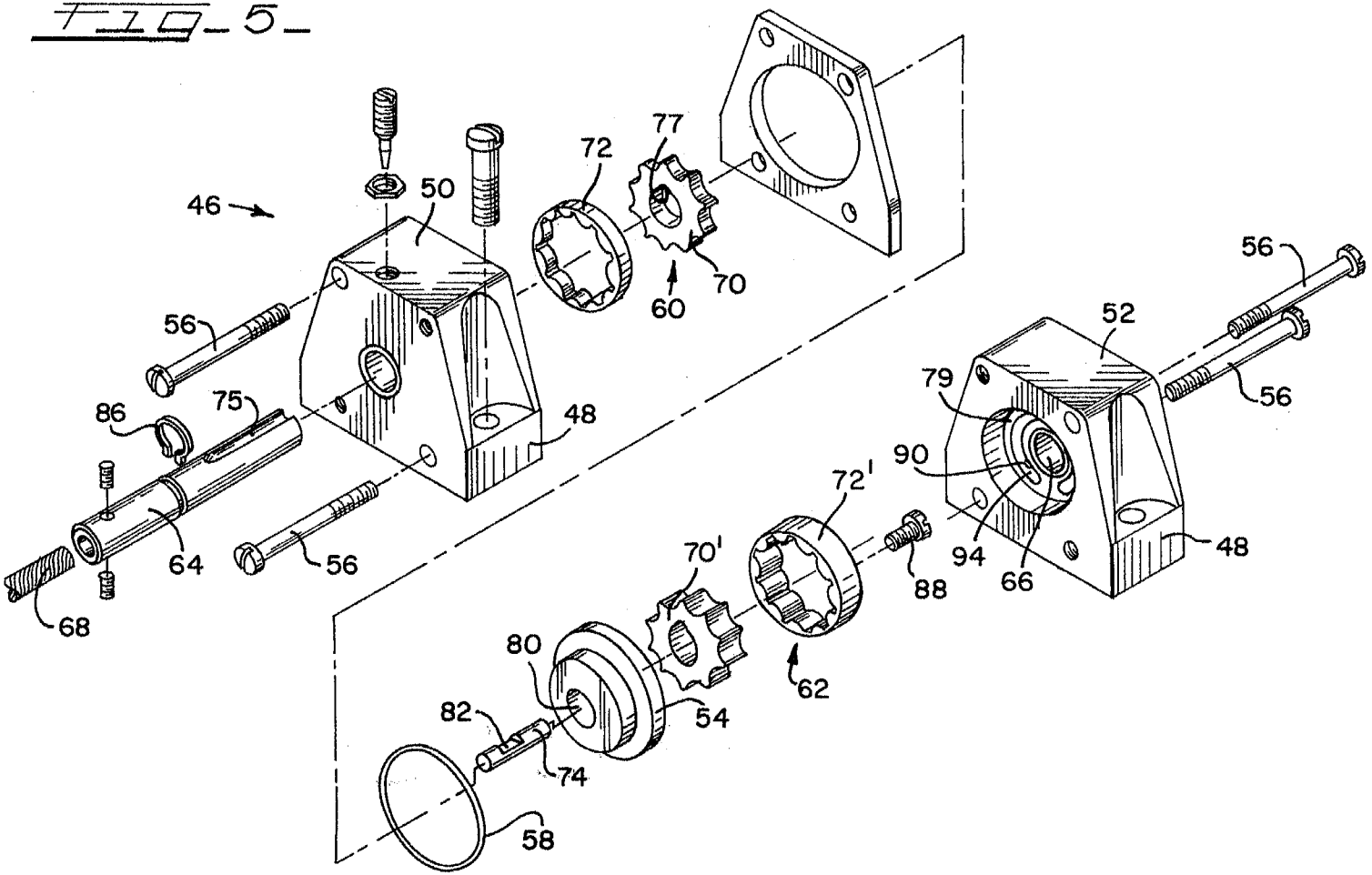
FIG. 5 is an exploded perspective view of the modular lubricant pump assembly.

As best seen in FIG. 5, with the present embodiment, the gerotor pump 60 is defined as a first stage low pressure pump assembly which includes intermeshing inner and outer rotor elements 70 and 72, respectively. The inner rotor 70 has a spline-type connection with the transmission shaft 64, said connection including a key or pin means 74 which may be accomodated in an elongated recess 75 formed on the periphery of shaft 64. The pin 74 also engages a correspondingly formed keyway 77 in rotor element 70 such that upon rotation of shaft 64 the inner rotor 70 rotates therewith. Each of the inner faces of the pump bodies is eccentrically formed with a cylindrical recess means 70 into which is seated the outer element or rotor 72. As may be appreciated by one skilled in the art, the annular rotor 72 may be allowed some degree of free rotation within the recess 79.

The other gerotor pump 62 acts as a second stage higher pressure pump assembly which can be housed within the pump body 52. The higher pressure pump assembly 62 is similarly constructed to the lower pressure pump assembly 60 in that it includes inner and outer rotor elements 70' and 72', respectively. The inner rotor 70' is drivingly connected to shaft 64 through an extension of pin 74. The inner element 70' is adapted to intermesh with the outer element 72' which, in turn, may be received in the above mentioned eccentrically arranged recess.

It may be seen from the drawings that the pump assemblies 60 and 62 are operatively separated by a partition or separator means 54. In the presently preferred embodiment, the separator means 54 is formed as a stepped disc-shaped body which may be interposed and clamped between the respective pump assemblies. It should be noted that the separator or partition means has a dual function. First, the separator is adapted to retain the pump assemblies 60 and 62 and the pin 74 as a unitary assembly while allowing, if necessary, for the pump or shaft 64 to be axially shifted a limited extent with respect to the housing or casing 48. Maintaining the pumps and pin as a unitary assemblage may be accomplished by providing the partition 54 with a cylindrical bore 80 which, when mounted on shaft 64, surrounds a reduced shoulder or lateral notch 82 formed on the periphery of pin 74, thus fixedly holding the rotors 70 and 70' and pin 74 in a fixed relationship relative to housing 48 when the shaft is axially moved.

It should be appreciated that the axial adjustment of the shaft 64 may be controlled within limits by a series of retainer means 86 and 88. As is apparent from FIG. 2, the retainer means 86 limits the movements of shaft 64 to the right while retainer means 88 controls the extent of movement of the shaft to the left. The retaining means 88 is arranged at the right end of shaft 64 and is adapted to engage the pin 74 when the shaft 64 has reached the limits of its movement to the left. That is, the shaft 64 is free to move to the left until such time as the free length of the elongated recess 75 is traversed, at which time the right end of pin 74 will engage the retaining means 88. The free or axial movement of the shaft is necessary so as to allow adjustment of the looper avoid motion as was discussed above.

The second function served by the partition 54 is that it is adapted to allow each of the pumps 60 and 62 to act independently of the other thus improving the operating characteristics of the pump assembly 46 as a whole. This second function is accomplished by adapting the separator 54 so that it may maintain the pumps 60 and 62 in their proper working relationship relative to the housing 48 and by sealing one pump assembly from another.

Each of the pump bodies is provided with inlet and outlet ports 90 and 92, respectively, and suitable lubricant passageways 94 whereby allowing communication between the gerotor pumps and the inlet and outlet ports. It should be noted that the inlet and outlet ports 90 and 92 for the pump assemblies are aligned with suitable passages 96 arranged in the bed 12 so as to allow communication between the pump and the lubricant reservoir 30. As may be appreciated, during the rotation of shaft 64, the gerotor pump 62 is operated whereby effecting the transmission of lubricant from the reservoir 30 to the inlet port 90 through suitable conduit means such as pipe 98. Since the pump assembly 46 is a positive displacement mechanism, the output flow thereof is proportional to the revolutions per minute imparted to the shaft or rotor 70'. The expansion and contraction of the displacement pockets between the rotors 70' and 72' produces volume changes which are essentially constant and which force lubricant from the inlet port 90 and deliver same under pressure to the outlet port 92. Leading from the discharge side of the pump is a conduit 100 which may be adapted to conduct the pressurized lubricant to a suitable cooling means (not shown) wherein the temperature of the lubricant, if necessary, is controlled.

Once the relative usefulness of the lubricant has expired, it simply gravitates back to the reservoir in that the lubricant is a given entity, that is, it is not affected by evaporation or condensation. As may be appreciated, however, there may be some areas in the machine frame which may be non-drainable, that is, the expired lubricant collects in these areas rather than draining to the machine reservoir. In this regard, it has been found desirable to provide the first stage lower pressure pump assembly 60 for positively transmitting lubricant from the non-drainable areas of the machine so as to return same to the reservoir 30. To this end, secured to the inlet port of pump assembly 60 is a conduit means 102. The lubricant conduit 102 is adapted to allow communication between the various non-drainable areas of the machine and the pump assembly 60. In operation, the actuation of pump assembly 60 is effective to transmit or draw any excess lubricant in the various non-drainable areas through the conduit 102 and to exhaust same, under pressure, from the outlet port back to the reservoir 30.

From the above description, it is apparent that there is provided a new and improved lubricant pump assembly for forcibly delivering lubricant to the various operable mechanisms of the machine and for establishing means for transmitting any excess lubricant from any non-drainable areas of the machine to the lubricant reservoir.

Figure 6:
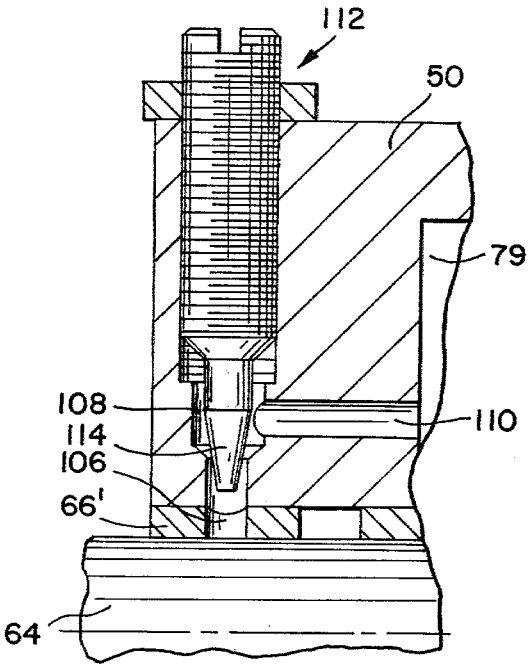
FIG. 6 is an enlarged sectional view showing but a part of the present invention.

Since the pump assembly 46 is a positive displacement mechanism which is used in combination with a lubricant metering means, it will be understood that the lubricant which exists in the space between the sleeve bearing and the shaft may be subjected to increasing pressure as the pump rotates. As is well known, the flow of any liquid follows a path of least resistance and, therefore, some lubricant may be forced outwardly along the bearing surface between the shaft 64 and the bearings. As mentioned above, in this preferred embodiment, the sleeve bearing 66 may be plugged and, therefore, will not allow the escapement of lubricant. However, bearing means 66' is not plugged and, therefore, it is possible for lubricant to escape to the periphery of the housing 48 via the bearing surface. Since the pump assembly 46 is disposed in a "dry" chamber, it is desirous to provide means which insure that the lubricant will not be allowed to escape beyond the periphery of the housing. Toward this end, and as may be best seen in the FIG. 6, the present invention provides means for preventing lubricant from leaking along the bearing surface. The means for preventing lubricant leakage include the sleeve bearing 66' which is formed with a radial port 106 that is arranged to communicate with a conduit 108 formed in the pump housing 50. The housing 50 is also provided with a bore 110 that is adapted to join the conduit 108 with the cylindrical recess 79 formed in the pump housing 50. In this manner, the negative pressure or suction in the cylindrical recess 79, caused by the actuation of the pump assembly 60, is effective to create a draft in the communicable means that is, the bore 110, the conduit 108 and the radial port 106. Accordingly, if any lubricant should be forced along the bearing surface, it will be drawn through the communicable means and directed back to the passageway 94. There may further be provided a needle valve means 112 which can be threadably engaged in the conduit 108 and may be provided with a needle valve stem 114. The needle valve stem may be adapted to expose, to an adjustable degree, a selected portion of the conduit means so as to regulate the flow through the communicable means. The importance of the needle valve toward the present invention is that is provides for adjustment according to the preset operating speed of the machine, thus preventing lubricant from escaping to the periphery of a pump over a range of machine speeds.

In order to properly control the flow of lubricant to the various operable mechanisms arranged in the machine frame, and more particularly to optimize the anti-frictional and heat dissipation characteristics of the lubricant, the present invention is provided with a modular lubricant dispensing means generally identified by reference numeral 120. Lubricant is delivered, under pressure, to the modular lubricant dispensing means from the oil cooler or, if preferred, directly from the modular lubricant pump assembly means 46. The lubricant dispensing means 120 is adapted to deliver lubricant in individually and accurately measured amounts to the plurality of operating mechanisms which are spatially arranged in the frame of the machine—i.e., the needle drive mechanism means, the feed mechanism means, the looper drive mechanism means, etc. The lubricant may be applied to the operating mechanisms in any of a variation of well known ways, but it is important to note that the lubricant flow is regulated in amounts corresponding to the minute requirements of the parts to be lubricated. The construction and operation of the modular lubricant dispensing means 120 will now be described in detail.

Referring to the drawings, the preferred embodiment of the modular lubricant dispensing means 120 is shown as comprising a one-piece body 122 having a lubricant dispensing portion 124 in which is carried a plurality of adjustable restrictive assembly means 126 and a lubricant filtering portion 128 which includes a second stage filter that is effectively interposed between the lubricant pump assembly 46 and the metering portion 124 and is adapted to prevent any micro sized particles from entering the adjustably restrictive means 126 whereby protecting the anti-friction bearings from abrasive components. It should be mentioned that the adjustable restrictive means correspond in number to the various operable mechanisms which are to be lubricated.

Figure 9:
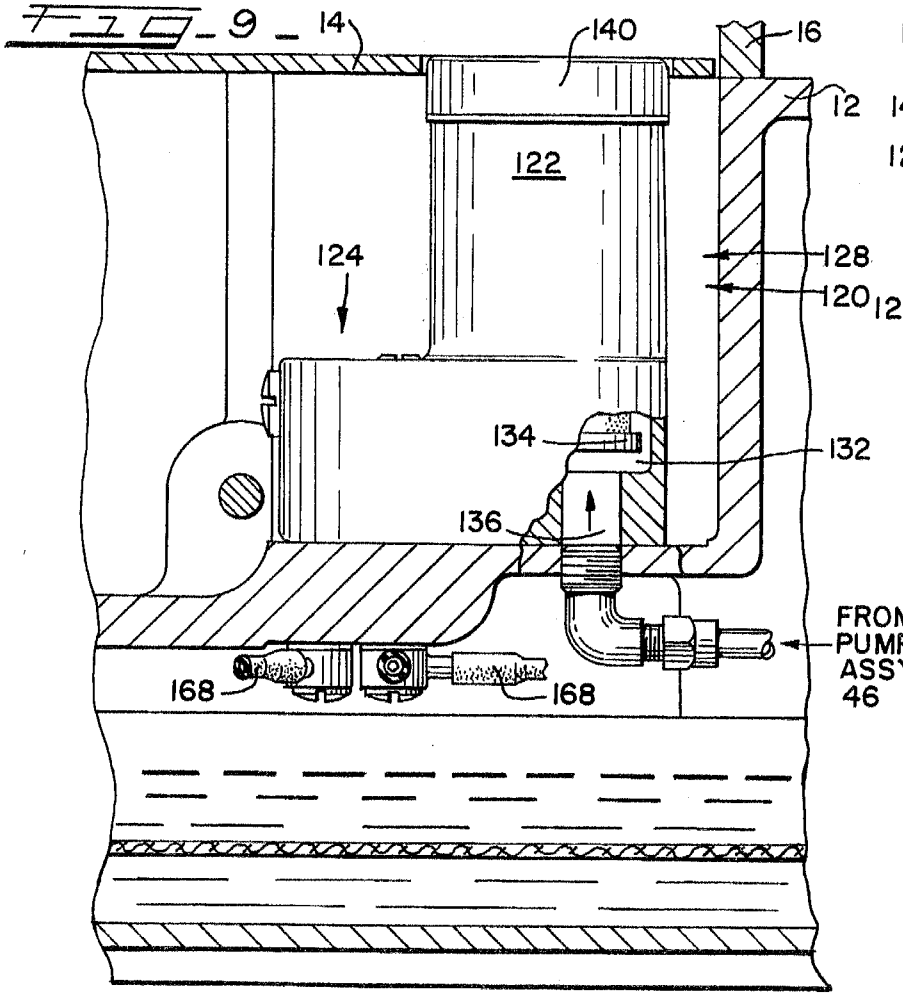
FIG. 9 is a fragmentary front elevational view, taken along line 9—9 of FIG. 7.

In the embodiment under construction, the one-piece body 122 is formed from any suitable material and is secured, in an oil tight fashion, to the bed or frame 12 by any suitable means such as screws 130. The body 122 is shown as having an open ended generally circular cavity 132 into which is fitted a replaceable filtering element or member 134. The filtering element 134 may be of any commercial type, preferably including pleats, i.e., it is folded in a zig-zag form, and has a filtering capacity of approximately 20 microns. As seen in FIG. 9, the body 122 is provided with an aperture 136 which, at one end, receives the lubricant from the lubricant pump assembly 46 while the other end thereof opens into the cavity 132. Thus, the lubricant presented to the lubricant dispensing means is filtered by element 134 before it is presented to the lubricant dispensing portion. A cover 140 is arranged at the open end of the cavity 134 such that the filtering element may be readily accessible and easy to replace.

The filtering element 134 is telescopically arranged over an insert piece 142 which is provided with a lubricant communicable bore 144. The body 122 is formed lengthwise with a central flow passage 146 which is arranged in combination with the bore 144 such that the filtered lubricant may flow from the cavity 132 to the dispensing portion 124 of the lubricant dispensing means 120. The dispensing portion of the body 122 is formed with a plurality of apertures 148 which intersect and, thus, communicate with the central flow passage and each of which are adapted to receive the adjustable restricting assembly means 126.

Figure 12:
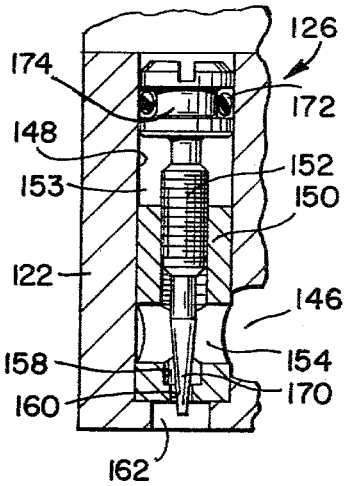
FIG. 12 is an enlarged sectional view of one element of the present invention.
Figure 7:
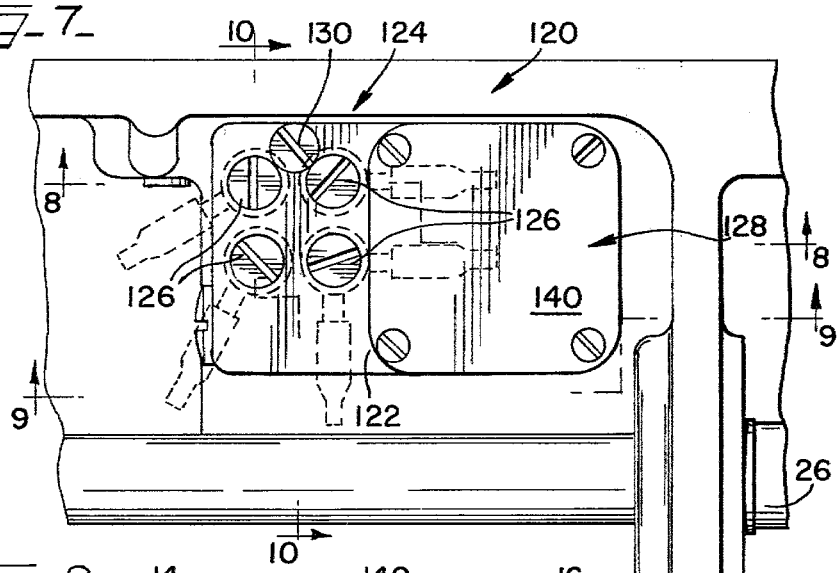
FIG. 7 is a fragmentary top view, taken partially in section, showing the modular lubricant dispensing means of the present invention.
Figure 8:
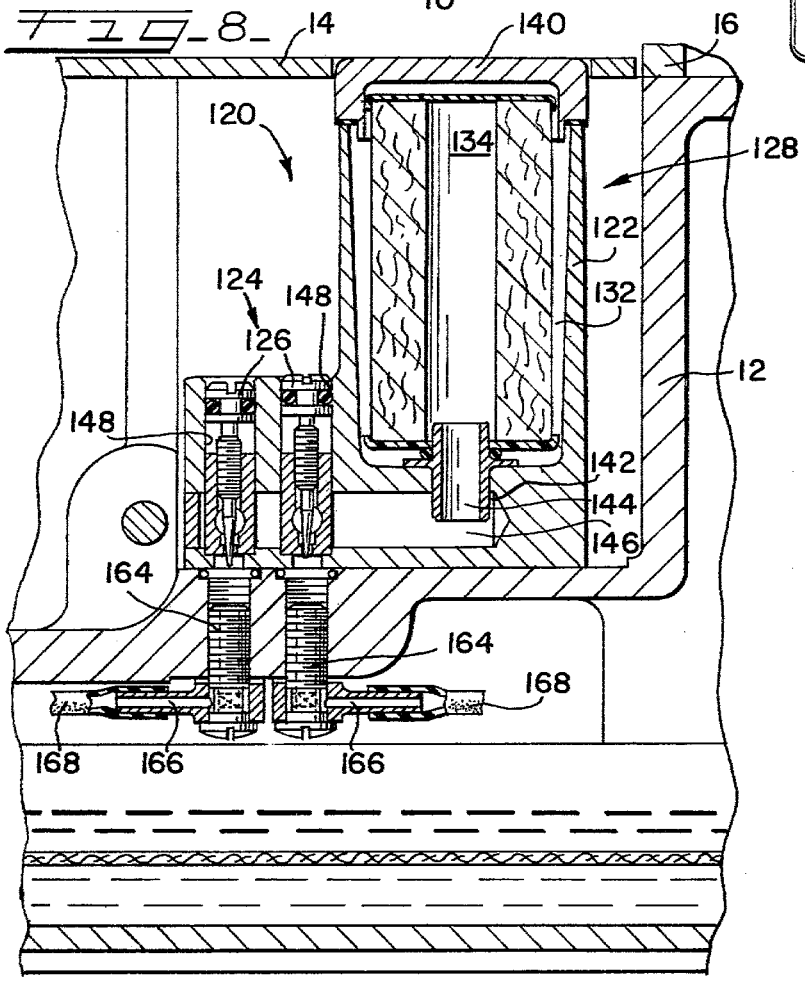
FIG. 8 is a fragmentary front elevational view, taken along line 8—8 of FIG. 7.

Since all of the adjustable restricting means 126 may be substantially the same, the embodiment shown in FIG. 12 will be described as representative of such means. As shown, the adjustable restrictive means 126 includes a valve body 150 and a needle valve means 152 which may be threadably engaged therewith. The valve body 150 is accommodated in a counterbore portion 153 of the aperture 148. The valve body 150 is formed with a radial port 154, joining the central passage 146 with an axial bore 158. The filtered lubricant may flow into the central conduit 146 through the radial bore 154 into the axial bore 158, and then through an outlet conduit 160. From the outlet conduit 160 the lubricant may flow through the aperture 162 and into an output fitting 164 (FIG. 8) threadably arranged in frame 12. A passageway 166 in the output fitting 164 communicates with flexible tubing or piping 168 which maybe provided for directing the lubricant from the distribution means 120 to the various operating mechanisms requiring lubrication. The plumbing internally of the machine is not illustrated in the drawings because this type of plumbing may be of the type which is well known in the art in lubricating systems which are arranged completely within the sewing machine casing.

As noted above, the distribution means of the present invention is provided with a needle valve means 152 for regulating the flow of lubricant to the various areas of the machine. Turning again to FIG. 12, it may be seen that the needle valve means of the present invention are preferably adjustably secured in the valve body 159 such that the needle valve stem 170 may be positioned in the outlet conduit means 160 and may be adjusted to expose a selected portion thereof so as to regulate the quantity of lubricant from the central bore 146 to the output connection 164. It may be appreciated, that the upper extremity of the needle valve means may be snuggly accommodated in the aperature 148 and sealing ring 172 may be seated in an annular groove 174 formed in the extremity of the needle valve so as to prevent leakage of lubricant between the needle valve and the aperature 148.

Figure 11:
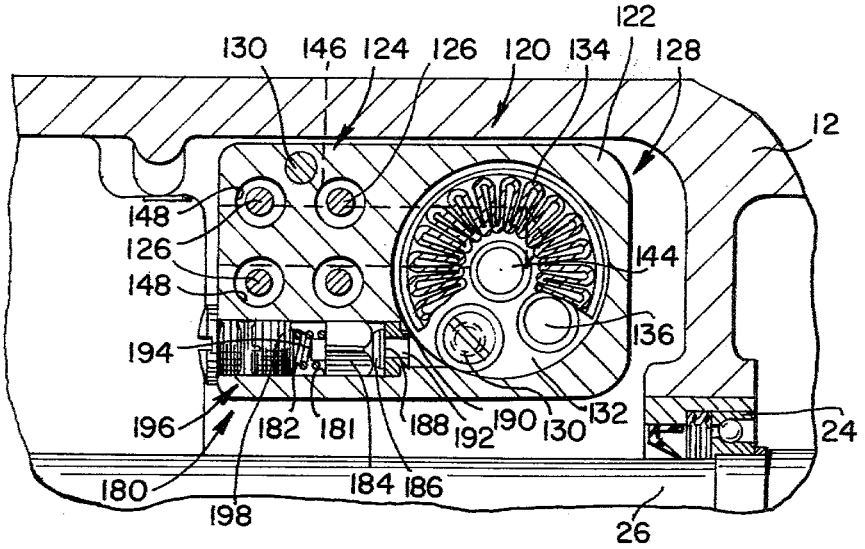
FIG. 11 is a fragmentary top sectional view, taken along line 11—11 of FIG. 10.
Figure 10:
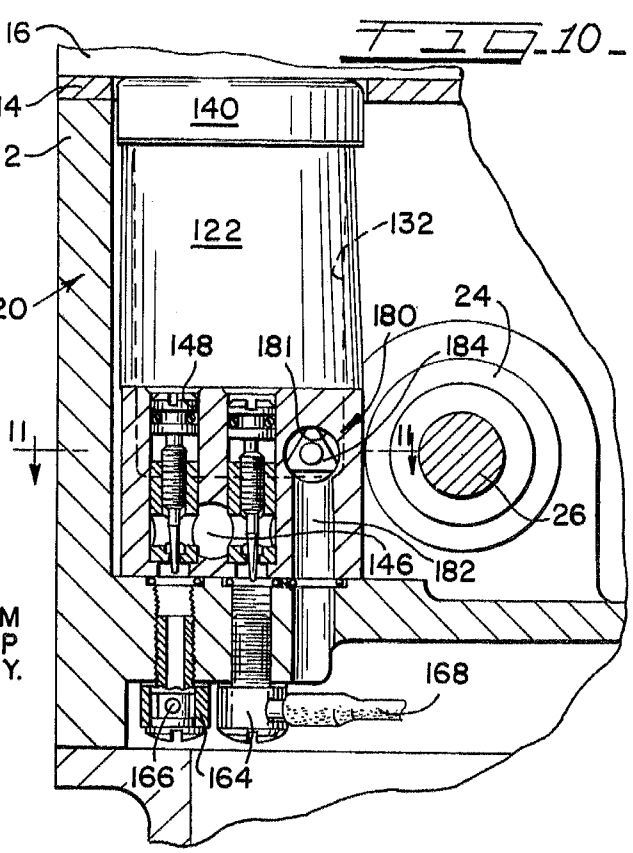
FIG. 10 is a fragmentary side elevational view, taken along line 10—10 of FIG. 7.

As illustrated in FIGS. 10 and 11, the lubricant dispensing means may further be provided with a pressure relief valve assembly means 180 which is rendered effective to maintain a preset or predetermined pressure in the system. For, as mentioned earlier, too little pressure in the system may effect the consistency of the lubricant flow to the operating components of the machine while too much pressure may cause the collapse of the filtering element. With the preferred embodiment, it has been found desirable that a setting of approximately 20 p.s.i. can optimize the flow of lubricant to the various mechanisms of the machine.

In the embodiment under construction, the body 122 is provided with two intersecting bores 181 and 182. The bore 181 leads away from the cavity 132 while the aperture or bore 182 is adapted to discharge any lubricant in the bore 181 back to the reservoir. It may be noted from FIG. 10, that the passageway 181 intersects the cavity 132 at a position such that it is adapted to draw off any sediment which may accumulate along the bottom of the cavity. Slidably arranged in the passageway 181 is the pressure relief valve assembly which, in the presently preferred embodiment, includes a valve member 184 that may be somewhat triangularly shaped so that a relatively smooth flow path is provided from the cavity 132 through the member 184 into the discharge passage 182. The member 184 may include a conically shaped end 186 having a generally flat face 188. In the preferred embodiment, and as seen in FIG. 11, a seat or retainer means 190 is arranged at the right hand end of the passageway 181 and is provided with a passage 192 so as to allow the flow of lubricant therethrough. The valve member 184 is continually biased toward the seat 190 by a resilient member 194, preferably a coil spring, which is stressed by an adjustable stop assembly 196 such that lubricant is prevented from flowing into the passage 181 until the lubricant pressure in the system is greater then the magnitude of pressure applied by the spring 194. Although not shown in the drawings, it is well within the scope of the present invention to provide the stop member with a nylon type insert thereby preventing the stop member from moving as a result of machine vibration. If the pressure in the system is greater than that exerted by the influence of the spring, the valve member 184 will permit draining of the excess lubricant, via passage 181, back to the reservoir until such time as the pressure in the system is returned to that set by the pressure relief valve assembly.

Although the adjustable stop assembly could take many forms within the scope of this invention, in the present embodiment it comprises a first movable stop member 198 which may be threadably received in the left hand end of the body 122 as viewed in FIG. 11. As shown, the passageway 181 is provided with internal threads which permits the member 198 to be shifted longitudinally in the passageway. Thus, the stop member may be threaded into the body to any desired position by use of a standard tool.

As best seen in FIG. 13, there may be provided a visual indicator 151 which will quickly and easily indicate through ocular inspection whether or not there is a flow of lubricant through the system. In the preferred embodiment, the visual indicator 151 is mounted in the upper arm of the machine at a point easily visible to the operator. The indicator is situated such that lubricant, to a limited degree, is splashed thereon as it is delivered to the upper arm of the machine.

In operation, rotation of shaft 64 will cause the actuation of the lubricant pump assembly. It is important to note that a minimal reaction force is placed on the bearing 66' journaling the shaft in view of the axial alignment of same with the input power source. The positive action of the gerotor pump serves two purposes. First, the lubricant pump assembly raises the lubricant from the reservoir 30 and delivers same, under pressure, to the lubricant dispensing means 120. Secondly, the action of the pump assembly 46 transfers any excess lubricant from various nondrainable areas of the machine and returns same to the lubricant reservoir.

The importance of the modular dispensing means of the invention toward the provision of an ideal lubrication is first, that it filters the lubricant, thus preventing dust, lint and foreign materials from entering into the system. Second, the provision of an accurately adjustable dispensing means coupled with a positive displacement pump assembly means assures that lubricant may be delivered to the various components of the machine in accurately metered amounts. In this manner, it is possible to optimize the antifrictional and heat dissipation characteristics of the lubricant. The provision of a pressure relief valve means in the present invention will assure a substantially constant lubricant pressure in the system throughout the speed range of the machine. The bypass valve means may further be used to optimize the flow rate through the dispensing means, thus, ensuring accurately measured amounts of lubricant to be delivered to the various areas of the machine.

The embodiment of the invention show and described herein is to be considered merely as illustrative as the invention is susceptible to variation, modification and change within the spirit and broad scope of the appended claims.

We claim:

1. A sewing machine having a frame, a series of stitch forming instrumentalities spatially arranged in said frame including a rotary input shaft for actuating same, and a lubrication system comprising:

a lubricant reservoir means;

lubricant pump means including:

pump housing means secured to said frame in an area removed from said reservoir means;

first mechanical positive displacement pump means arranged in said housing means for transmitting filtered lubricant from said reservoir and delivering same, under pressure, to the instrumentalities arranged in the frame;

second mechanical positive displacement pump means coaxially arranged in said housing means relative to said first pump means for transmitting lubricant;

a pump actuating shaft operatively connected to the rotary input shaft of one of said stitch forming instrumentalities for simultaneously imparting motion to said first and second pump means;

means operative for filtering and distributing selectively controlled individual amounts of lubricant to each of said instrumentalities; and pressure responsive valve means adapted to selectively regulate the pressurized flow of lubricant delivered to each of said instrumentalities.

2. The lubrication system of claim 1 wherein said positive displacement mechanism means includes gerotor type pump means.

3. The lubrication system of claim 1 wherein the free end of said pump shaft extends beyond the pump housing means and further includes means for preventing lubricant from escaping along the bearing surface adjacent the free end of the shaft.

4. The lubrication system of claim 3 wherein said preventing means includes at least one apertured bearing means adapted to rotatably support said pump shaft, and communicable means arranged in communication with the apertured bearing for influencing the flow of lubricant along the bearing surface.

5. The lubrication system of claim 4 further including means adjustably associated with said communicable means for effecting the flow of lubricant along the bearing surface over a range of machine speeds.

6. The lubrication system of claim 1 wherein said pump housing means comprises a pair of generally complementary separable pump bodies and a retainer means normally maintaining said pump bodies as an assembled unit, said retainer means being adapted to permit separation of the pump bodies so as to facilitate assembly and disassembly of said pump means.

7. The sewing machine of claim 1 wherein said pressure responsive valve means comprises:

valve member means;

means for continually biasing said valve member means such that a predetermined pressure is maintained within the system during the operable working of the machine; and adjustment means for modulating the force applied against said valve means, said adjustment means includes an adjustable member in engagement with said biasing means and threadably arranged in said lubricant dispensing means.

8. The sewing machine of claim 7 wherein said biasing means comprises a coil spring positioned between said valve member means and said adjustment means.

9. The lubrication system of claim 1 wherein said pump actuating shaft is axially movable.

10. The lubrication system of claim 9 further comprising means associated with said pump actuating shaft for restraining the axial movement of said shaft beyond a predetermined range.

11. A sewing machine having a frame, an oscillatory looper means, looper drive means including a rotary shaft as the source of oscillatory motion for said looper, a series of operable mechanisms spatially arranged in the frame, and a lubrication system comprising:

lubricant reservoir means;

lubricant pump means for transmitting lubricant to and from various areas in the machine frame, said lubricant pump means including tandemly arranged first and second positive displacement pump means, pump shaft means coaxially arranged relative to the rotary input shaft of said looper drive means adapted to simultaneously impart motion to said first and second pump means, flexible coupling means operatively connecting the pump actuating shaft with the rotary input shaft of said looper drive means;

lubricant filtering/dispensing means connected to the lubricant pump means for individually governing the lubricant flow to the various operable mechanisms;

lubricant bypass means for influencing the output of said lubricant filtering/dispensing means and for maintaining a predetermined pressure throughout the system during operation of the machine.

12. The lubrication system of claim 11 further including means disposed on said pump shaft means for operatively separating said first and second pump means.

13. The lubrication system of claim 11 wherein one of said pump means is adapted to provide a continuous supply of lubricant to said operable mechanism means and the other pump assembly is effective to transmit surplus lubricant.

* * * * *